US009534185B2

(12) United States Patent
Dodd et al.

(10) Patent No.: US 9,534,185 B2
(45) Date of Patent: Jan. 3, 2017

(54) MARINE ENGINE LUBRICATION

(71) Applicants: James C. Dodd, Didcot (GB); Louise Renouf, Didcot (GB)

(72) Inventors: James C. Dodd, Didcot (GB); Louise Renouf, Didcot (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 13/852,324

(22) Filed: Mar. 28, 2013

(65) Prior Publication Data

US 2013/0281334 A1 Oct. 24, 2013

(30) Foreign Application Priority Data

Mar. 29, 2012 (EP) ..... 12162222

(51) Int. Cl.
*C10M 169/04* (2006.01)
*C10M 159/22* (2006.01)
*C10M 129/26* (2006.01)

(52) U.S. Cl.
CPC ..... *C10M 129/26* (2013.01); *C10M 169/045* (2013.01); *C10M 2203/1006* (2013.01); *C10M 2207/127* (2013.01); *C10M 2207/129* (2013.01); *C10M 2207/262* (2013.01); *C10M 2219/046* (2013.01); *C10N 2220/082* (2013.01); *C10N 2230/04* (2013.01); *C10N 2230/08* (2013.01); *C10N 2230/52* (2013.01); *C10N 2230/78* (2013.01)

(58) Field of Classification Search
CPC ..... C10M 2207/129; C10N 2210/02
USPC ..... 508/306, 460
See application file for complete search history.

(56) References Cited

U.S. PATENT DOCUMENTS

| | | | | |
|---|---|---|---|---|
| 6,599,867 | B2 * | 7/2003 | Hammond et al. | 508/460 |
| 2011/0077179 | A1 * | 3/2011 | Van Houten et al. | 508/287 |

FOREIGN PATENT DOCUMENTS

| | | | |
|---|---|---|---|
| EP | 2071009 | A1 | 6/2009 |
| EP | 2308953 | A1 | 4/2011 |
| EP | 2402421 | A2 | 1/2012 |
| WO | WO-2010/115595 | A1 | 10/2010 |

* cited by examiner

*Primary Examiner* — Vishal Vasisth

(57) ABSTRACT

Trunk piston marine engine lubrication, when the engine is fueled by heavy fuel oil, is effected by a composition of TBN in the range of 20 to 60 comprising a major amount of an oil of lubricating viscosity containing 50 mass % or more of a Group 1 basestock, and respective minor amounts of a calcium alkyl salicylate detergent system providing 40 to 90 mmol of calcium alkyl salicylate per kg of the composition, and 1 to 7 mass %, based on the mass of the composition, of an oil-soluble polyalkenyl-substituted carboxylic acid anhydride, wherein the or at least one polyalkenyl group is derived from a polyalkene having a number average molecular weight of from 200 to 3,000. Asphaltene precipitation in the lubricant, caused by the presence of contaminant heavy fuel oil, is prevented or inhibited.

7 Claims, No Drawings

MARINE ENGINE LUBRICATION

FIELD OF THE INVENTION

This invention relates to a trunk piston marine engine lubricating composition for a medium-speed four-stroke compression-ignited (diesel) marine engine and lubrication of such an engine.

BACKGROUND OF THE INVENTION

Marine trunk piston engines generally use Heavy Fuel Oil ('HFO') for offshore running. Heavy Fuel Oil is the heaviest fraction of petroleum distillate and comprises a complex mixture of molecules including up to 15% of asphaltenes, defined as the fraction of petroleum distillate that is insoluble in an excess of aliphatic hydrocarbon (e.g. heptane) but which is soluble in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer which can result in the formation of cracks that then propagate through the piston. If a crack travels through the piston, hot combustion gases can enter the crankcase, possibly resulting in a crankcase explosion.

It is therefore highly desirable that trunk piston engine oils ('TPEO's) prevent or inhibit asphaltene precipitation. The prior art describes ways of doing this.

WO 2010/115594 ("594") and WO 2010/115595 ("595") describe the use, in trunk piston marine engine lubricating oil compositions that contain 50 mass % or more of a Group II basestock, of respective minor amounts of a calcium salicylate detergent and of a polyalkenyl-substituted carboxylic and anhydride. The data in "594" and "595" show that the combination gives rise to improved asphaltene dispersancy.

"594" and "595" are not, however, concerned with the economics of treating TPEO's to inhibit 'black paint' formation when a Group I base oil is used. A considerable cost arises from the amount of detergent soap that is used, i.e. the detergent other than the basic material. It is now found that, by using relatively small additions of the above anhydride, it is possible to achieve good asphaltene dispersancy properties at lower, and therefore more economic levels, of soap.

SUMMARY OF THE INVENTION

A first aspect of the invention is a trunk piston marine engine lubricating oil composition of TBN in the range of 20 to 60, such as 30 to 55, for improving asphaltene handling in use thereof, in operation of the engine when fuelled by a heavy fuel oil, which composition comprises or is made by admixing an oil of lubricating viscosity, in a major amount, containing 50 mass % or more of a Group I basestock, preferably containing 55 mass % or more of a Group I basestock, and, in respective minor amounts:

(A) a calcium alkyl salicylate detergent system providing 40 to 90, such as 50 to 85 or 60 to 80, mmol of calcium alkyl salicylate per kg of the composition, as determined by titration; and (B) 1 to 7, such as 1.5 to 5, mass % active ingredient, based on the mass of the composition, of a polyalkenyl-substituted carboxylic acid anhydride, wherein the or at least one polyalkenyl group is derived from a polyalkene having a number average molecular weight of from 200 to 3,000.

By "system" is meant a single calcium alkyl salicylate detergent or a mixture of two or more such detergents.

A second aspect of the invention is a method of operating a trunk piston medium-speed compression-ignited marine engine comprising (i) fuelling the engine with a heavy fuel oil; and (ii) lubricating the crankcase of the engine with a composition according to the first aspect of the invention.

A third aspect of the invention is a method of dispersing asphaltenes in a trunk piston marine lubricating oil composition during its lubrication of surfaces of the combustion chamber of a medium-speed compression-ignited marine engine and operation of the engine, which method comprises:

(i) providing a composition according to the first aspect of the invention;

(ii) providing the composition in the combustion chamber;

(iii) providing heavy fuel oil in the combustion chamber; and (iv) combusting the heavy fuel oil in the combustion chamber.

A fourth aspect of the invention is the use of detergent (A) in combination with component (B) as defined in and in the amounts stated according to the first aspect of the invention in a trunk piston marine lubricating oil composition of TBN in the range of 20 to 60, such as 30 to 55, for a medium-speed compression-ignited marine engine, which composition comprises an oil of lubricating viscosity in a major amount and contains 50 mass % or more of a Group I basestock, preferably contains 55 mass % or more of a Group I basestock, to improve asphaltene handling during operation of the engine, fuelled by a heavy fuel oil, and its lubrication by the composition.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more of a composition;

"minor amount" means less than 50 mass % of a composition;

"TBN" means total base number as measured by ASTM D2896.

Furthermore in this specification, if and when used:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV 100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be discussed in more detail below.

Oil of Lubricating Viscosity

The lubricating oils may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment, are unrefined oils. Refined oils are similar to unrefined oils except that the oil is further treated in one or more purification steps to improve one or more properties. Many such purification techniques, such as distillation, solvent extraction, acid or base extraction, filtration and percolation, are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes Group 1 base stocks as follows:

Group I base stocks contain less than 90 percent saturates and/or greater than 0.03 percent sulphur and have a viscosity index greater than or equal to 80 and less than 120 using the test methods specified in Table E-1.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

As stated, the oil of lubricating viscosity in this invention contains 50 mass % or more of the defined basestock or a mixture thereof. Preferably, it contains 60, such as 70, 80 or 90, mass % or more of the defined basestock or a mixture thereof. The oil of lubricating viscosity may be substantially all the defined basestock or a mixture thereof.

Calcium Alkyl Salicylate Detergent System (A)

A metal detergent is an additive based on so-called metal "soaps", that is metal salts of acidic organic compounds, sometimes referred to as surfactants. They generally comprise a polar head with a long hydrophobic tail. Overbased metal detergents, which comprise neutralized metal detergents as the outer layer of a metal base (e.g. carbonate) micelle, may be provided by including large amounts of metal base by reacting an excess of a metal base, such as an oxide or hydroxide, with an acidic gas such as carbon dioxide.

In the present invention, (A) is a calcium alkyl-substituted salicylate system.

A detergent of such a system typically has the structure shown:

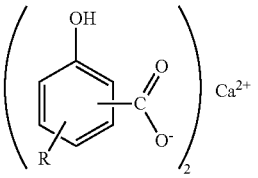

wherein R is a linear alkyl group. There may be more than one R group attached to the benzene ring. The $COO^-$ group can be in the ortho, meta or para position with respect to the hydroxyl group; the ortho position is preferred. The R group can be in the ortho, meta or para position with respect to the hydroxyl group.

Salicylic acids are typically prepared by the carboxylation, by the Kolbe-Schmitt process, of phenoxides, and in that case, will generally be obtained (normally in a diluent) in admixture with uncarboxylated phenol. Salicylic acids may be non-sulphurized or sulphurized, and may be chemically modified and/or contain additional substituents. Processes for sulphurizing an alkyl salicylic acid are well known to those skilled in the art, and are described, for example, in US 2007/0027057.

The alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term 'low-based' is used to describe metal detergents in which the equivalent ratio of metal moiety to acid moiety is greater than 1, and up to about 2.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may be expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500).

As stated, 40-90, such as 50-85 or 60-80, mmol of calcium alkyl salicylate per kg of the composition is provided, the values being determined by titration. Preferably, the values are in the range of 50-80, more preferably 50-70, mmol/kg.

Polyalkenyl-Substituted Carboxylic Acid Anhydride (B)

As stated, the anhydride constitutes at least 1 to 7, such as 1.5 to 5 mass % of the lubricating oil composition. Preferably it constitutes 2 to 5, for example 3 to 5, mass %.

The anhydride may be mono or polycarboxylic, preferably dicarboxylic. The polyalkenyl group preferably has from 8 to 400, such as 8 to 100, carbon atoms.

General formulae of exemplary anhydrides may be depicted as

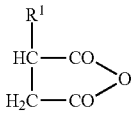

where $R^1$ represents a $C_8$ to $C_{100}$ branched or linear polyalkenyl group:

The polyalkenyl moiety may have a number average molecular weight of from 200 to 3000, preferably from 350 to 950.

Suitable hydrocarbons or polymers employed in the formation of the anhydrides of the present invention to generate the polyalkenyl moieties include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1,4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers may contain a minor amount, e.g. 0.5 to 5 mole % of a $C_4$ to $C_{18}$ non-conjugated diolefin comonomer. However, it is preferred that the polymers comprise only alpha-olefin homopolymers, interpolymers of alpha-olefin comonomers and interpolymers of ethylene and alpha-olefin comonomers. The molar ethylene content of the polymers employed is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-C($R^1$)═$CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-CH═$CH_2$, and a portion of the polymers can contain internal monounsaturation, e.g. POLY-CH═CH($R^1$), wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75 mass %, and an isobutene content of about 30 to about 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from 400 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

To produce (B) the hydrocarbon or polymer backbone may be functionalized, with carboxylic anhydride-producing moieties selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic, anhydrides and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, with carboxylic acid anhydride moieties by reacting the polymer or hydrocarbon under conditions that result in the addition of functional moieties or agents, i.e., acid, anhydride, onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, (carboxylic reactant), are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or derivative) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, or acid derivative material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

The treat rate of additives (A) and (B) contained in the lubricating oil composition may for example be in the range of 1 to 2.5, preferably 2 to 20, more preferably 5 to 18, mass %.

Co-Additives

The lubricating oil composition of the invention may comprise further additives, different from and additional to (A) and (B). Such additional additives may, for example include ashless dispersants, other metal detergents, anti-wear agents such as zinc dihydrocarbyl dithiophosphates, anti-oxidants and demulsifiers. In some cases, an ashless dispersant need not be provided.

It may be desirable, although not essential, to prepare one or more additive packages or concentrates comprising the additives, whereby additives (A) and (B) can be added simultaneously to the base oil to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant. Thus, additives (A) and (B), in accordance with the present invention, may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations as a trunk piston engine oil may typically contain 30, preferably 10 to 28, more preferably 12 to 24, mass % of the additive package(s), the remainder being base oil. The trunk piston engine oil has a compositional TBN (using ASTM D2896) of 20 to 60, such as, 30 to 55. For example, it may be 40 to 55 or 35 to 50. When the TBN is high, for example 45-55, the concentration of (A) may be higher. When the TBN is lower, for example 30 to below 45, the concentration of (A) may be lower.

The present invention is illustrated by but in no way limited to the following examples.

Components

The following components were used:

Component (A1): a calcium alkyl salicylate detergent comprising a mixture of a first calcium alkyl salicylate detergent (basicity index 3) and a second calcium alkyl salicylate detergent (basicity index 7.8) in a ratio of 0.85:1

Component (A2): a calcium alkyl salicylate detergent comprising a mixture of the above first and second detergents, but in a ratio of 0.62:1

Component (A3): a calcium alkyl salicylate detergent comprising a mixture of the above first and second detergents, but in a ratio of 0.28:1

Component (B): a polyisobutene succinic anhydride ("PIBSA") derived from a polyisobutene having a number average molecular weight of 950

Base oil I: solvent-extracted API Group I base oil

HFO: a heavy fuel oil (ISO-F-RMK 380)

Lubricants

Selections of the above components were blended to give a range of trunk piston marine engine lubricants. Some of the lubricants are examples of the invention; others are reference examples for comparison purposes. The compositions of the lubricants tested when each contained HFO are shown in the tables below under the "Results" heading.

Testing

Light Scattering

Test lubricants were evaluated for asphaltene dispersancy using light scattering according to the Focused Beam Reflectance Method ("FBRM"), which predicts asphaltene agglomeration and hence 'black sludge' formation.

The FBRM test method was disclosed at the $7^{th}$ International Symposium on Marine Engineering, Tokyo, $24^{th}$-28 Oct. 2005, and was published in 'The Benefits of Salicylate Detergents in TPEO Applications with a Variety of Base Stocks', in the Conference Proceedings. Further details were disclosed at the CIMAC Congress, Vienna, $21^{St}$-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on base stocks containing greater than or less than 90% saturates, and greater than or less than 0.03% sulphur. The predictions of relative performance obtained from FBRM were confirmed by engine tests in marine diesel engines.

The FBRM probe contains fibre optic cables through which laser light travels to reach the probe tip. At the tip, an optic focuses the laser light to a small spot. The optic is rotated so that the focussed beam scans a circular path between the window of the probe and the sample. As particles flow past the window, they intersect the scanning path, giving backscattered light from the individual particles.

The scanning laser beam travels much faster than the particles; this means that the particles are effectively stationary. As the focussed beam reaches one edge of the particle the amount of backscattered light increases; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time, the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The test lubricant formulations were heated to 60° C. and stirred at 400 rpm; when the temperature reached 60° C. the FBRM probe was inserted into the sample and measurements made for 15 minutes. An aliquot of heavy fuel oil (10% w/w) was introduced into the lubricant formulation under stirring using a four-blade stirrer (at 400 rpm). A value for the average counts per second was taken when the count rate had reached an equilibrium value (typically overnight).

Results

Light Scattering

The results of the FBRM tests are summarized in TABLE 1 below, where lower particle count indicates better performance.

Reference examples designated "Ref". Examples marked with an asterisk are for reference or comparison purposes only.

TABLE I

| Ex | PIBSA (mass % A1) | Detergent (soap level) A1 (80 mmol) | A2 (70 mmol) | A3 (50 mmol) |
|---|---|---|---|---|
| Ref | 0 | 4,528.93* | 6,0603* | 6,232.42* |
| 1 | 0.72 | 2,239.37* | 1,955.4 | 3,693.09 |
| 2 | 2.16 | 47.97* | 52.53 | 104.64 |
| 3 | 3.6 | 40.28* | 47.56 | 31.83 |
| 4 | 7.2 | 32.67* | 36.48 | 29.91 |

The results show that, when PIBSA is absent (as in the reference examples), performance is better when the soap level is higher. When PIBSA is present, (as in Examples 1-4), the performance may, at lower soap levels, be as good as or better than the performance at higher soap levels.

What is claimed is:

1. A trunk piston marine engine lubricating oil composition having a TBN in the range of 20 to 60 mg KOH/g, for improving asphaltene handling in use thereof, in operation of the engine when fuelled by a heavy fuel oil, which composition comprises or is made by admixing an oil of lubricating viscosity, in a major amount, containing 50 mass % or more of a Group I basestock, and in respective minor amounts:

(A) a calcium alkyl salicylate detergent system providing 40 to 90 mmol of calcium alkyl salicylate per kg of the composition, as determined by titration; and (B) 1 to 7 mass % active ingredient, based on the mass of the composition, of a polyalkenyl-substituted succinic acid or succinic anhydride, wherein the polyalkenyl group is derived from a polyalkene having a number average molecular weight of from 350 to 950.

2. The composition as claimed in claim 1 wherein the oil of lubricating viscosity contains more than 60 mass % of a Group I basestock.

3. The composition as claimed in claim 1 where (B) is a polyisobutene succinic acid or anhydride.

4. The composition as claimed in claim 1 wherein at least one calcium alkyl salicylate detergent of (A) is $C_9$ to $C_{30}$ alkyl-substituted.

5. The composition as claimed in claim 1 with a heavy fuel oil content.

6. A method of operating a trunk piston medium-speed compression-ignited marine engine comprising (i) fuelling the engine with a heavy fuel oil; and (ii) lubricating the crankcase of the engine with a composition as claimed in claim 1.

7. A method of dispersing asphaltenes in a trunk piston marine lubricating oil composition during its lubrication of surfaces of the combustion chamber of a medium-speed compression-ignited marine engine and operation of the engine, which method comprises:

(i) providing a composition as claimed in claim 1;

(ii) providing the composition in the combustion chamber;

(iii) providing heavy fuel oil in the combustion chamber; and (iv) combusting the heavy fuel oil in the combustion chamber.

* * * * *